US005167527A

United States Patent [19]

Clark

[11] Patent Number: 5,167,527

[45] Date of Patent: Dec. 1, 1992

[54] ELECTRICAL PLUG ASSEMBLY

[75] Inventor: William E. Clark, Syracuse, N.Y.

[73] Assignee: Cooper Industries, Inc., Houston, Tex.

[21] Appl. No.: 725,170

[22] Filed: Jul. 3, 1991

[51] Int. Cl.[5] ..... H01R 13/58

[52] U.S. Cl. ..... 439/469; 439/321; 29/857

[58] Field of Search ..... 439/462, 460, 469, 312, 439/313, 315, 321; 29/857

[56] References Cited

U.S. PATENT DOCUMENTS

| | | | |
|---|---|---|---|
| 3,624,591 | 11/1971 | Buberniak | 439/462 |
| 3,675,184 | 7/1972 | Vetter | 439/462 |
| 3,739,318 | 6/1973 | Winter et al. . | |
| 3,894,168 | 10/1976 | Korman . | |
| 3,989,340 | 11/1976 | Sheldon et al. . | |
| 4,114,974 | 9/1978 | Lawrence | 439/462 |
| 4,151,039 | 5/1979 | Shah | 439/321 |
| 4,304,455 | 12/1981 | McLaughlin et al. | 439/469 |
| 4,323,727 | 4/1982 | Berg . | |
| 4,390,227 | 6/1983 | Deutsch | 439/462 |
| 4,708,663 | 11/1987 | Eckart | 439/469 |
| 4,874,332 | 10/1989 | Munroe . | |

*Primary Examiner*—Eugene F. Desmond

*Attorney, Agent, or Firm*—Eddie E. Scott; William B. Patterson; Alan R. Thiele

[57] ABSTRACT

An electrical plug assembly providing internal, adjustable gripping means and sealing means for electrical cords of various sizes. The internal, adjustable gripping means is a three-jaw grip assembly using pie-shape jaws which are slidably mounted on tracks and moved towards and away from the center of plug body to form a gripping circle around cords of various sizes. The cord seal consists of a notched rubber bushing formed between two rings. As the cover is tightened over the clamping jaws, the rings on either sides of the rubber bushing are urged together causing the bushing to collapse inward and seal the cord. The cord seal also provides means for locking the cord seal in place and increasing torque needed to remove the cover.

55 Claims, 6 Drawing Sheets 10
20
42
130
140
55
150
12
12
60
40
62
65
34
35
75
70
21
30
50

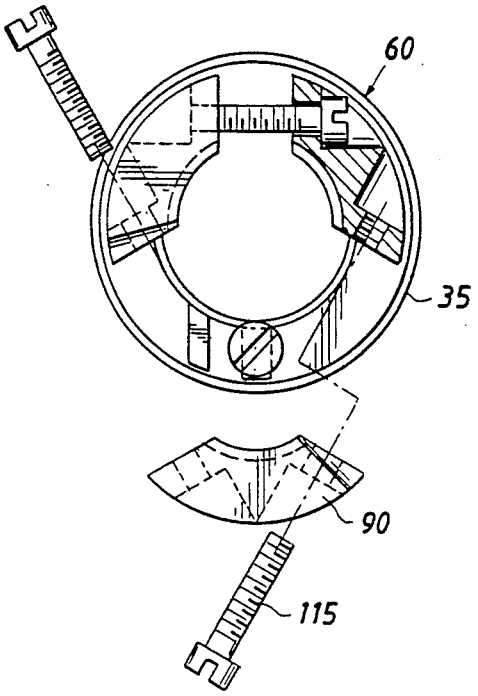
FIG. 4
FIG. 5
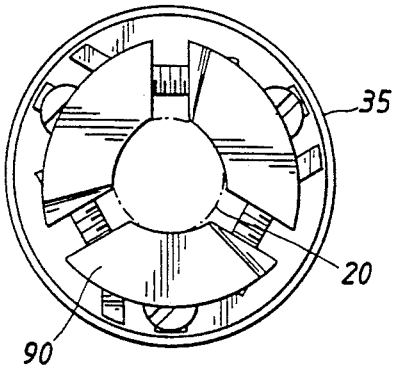
FIG. 6
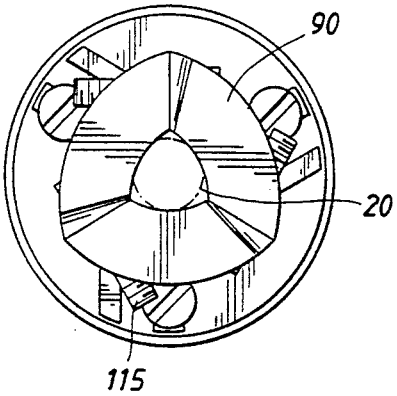
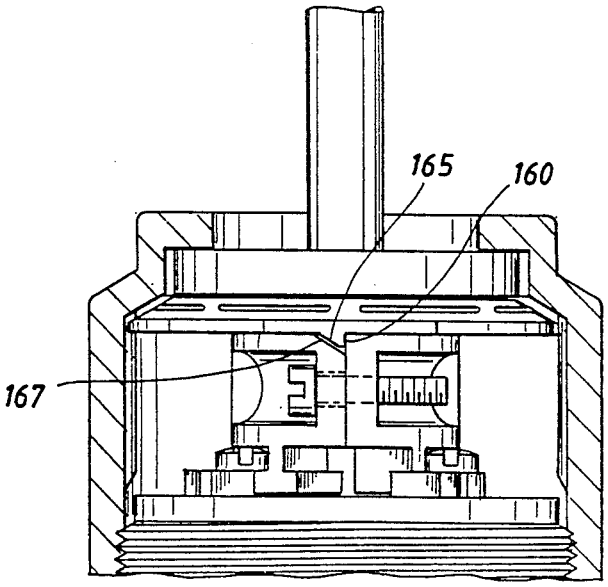
FIG. 7

ELECTRICAL PLUG ASSEMBLY

BACKGROUND OF THE INVENTION

The present invention relates to electrical plugs; more particularly, the invention relates to heavy duty electrical plugs in the 30, 60 and 100 amp range which will grip and seal electrical cords of different diameters.

Heavy duty electrical plugs are used to connect high current, portable electrical equipment to electrical receptacles. The plugs provide for termination of an electrical cord into a number of prongs which are mated to the receptacle. The plug assemblies usually consist of a body, a cover secured to one end of the body where the electrical cord enters and a plug sleeve attached to the opposite end of the body where the prongs are located. Typically, the size of the plug assemblies varies between 30, 60 and 100 amp applications.

Because the electrical equipment with which these plugs are used is generally portable and is moved around a worksite, the plugs must be able to withstand pulling without the cord separating from the plug. Certain pulling force standards have been established by Underwriters Laboratories for these plugs. For example, a 30 amp plug must withstand a pull of 150 pounds whereas a 60 or 100 amp plug must withstand a pull of 300 pounds. To satisfy the standard pull tests, gripping devices are used to secure the cord to the plug body.

The problem of cord gripping is made more challenging by cords of different diameters which are used in the same size plug assemblies. For example, in the 60 amp range, the outside diameter of a cord can vary between ¾" and 1.4" Therefore, the cord gripping arrangements of each plug must be adjustable to accommodate electrical cords of various diameters.

Various arrangements presently exist for securing cords of different diameters to the body of a heavy duty plug. In one arrangement, the gripping mechanism consists of an adjustable, two-jaw clamp, externally mounted at one end of the plug where the cord enters the plug body. U.S. Pat. No. 3,739,318 discloses such an external clamp. In a hostile environment, this external clamping arrangement is subject to damage and the adjusting screws on the clamp can loosen and become lost. In a more recent clamping arrangement, the two-jaw clamp is enclosed in a cover. However, the adjusting screws used to tighten the clamp are located outside the cover exposing them to possible damage. An additional problem with all two-jaw clamps is that they grip in only two directions, causing the circular cord to become deformed and flattened. U.S. Pat. No. 4,874,332 provides for an internal adjustable clamp, but the clamp is for light duty use and secures individual conductors only; not the main cord. There is, therefore, a need for a cord grip which can grip a variety of different sizes of electrical cords, but is protected by being placed within the plug body.

In addition to the need for gripping cords of varying sizes, plugs must also provide an environmental seal to prevent moisture, dirt and fumes from entering the plug body. In prior art plug assemblies, users have been provided with bushings of different sizes. A bushing is then chosen for the particular cord to be used. Unused bushings are then discarded thus creating unnecessary waste and contributing to the pollution of the environment. If the plug is to be reused with an electrical cord of a different diameter, the proper size bushing may be lost and the plug will then be used with an improperly sized bushing or even without a bushing.

There is a need therefore, for an electrical plug body which will both internally secure an electrical cord of varying diameters and provide an internal environmental seal around electrical cords of varying diameter without the need for additional bushings. Such plugs should also be easy to use yet provide for secure mounting to electrical cords.

SUMMARY OF THE INVENTION

The electrical plug assembly of the present invention provides for an internal, adjustable gripping means for electrical cords of various sizes and a weather tight seal for electrical cords of various sizes. In addition, the electrical plug assembly of the present invention is easy to use and provides for secure mounting to electrical cords.

The internal adjustable gripping means is a three-jaw grip assembly. Pie-shaped jaws are arranged around the end of the plug body and are slidably mounted on tracks. This allows each jaw to move towards and away from the center of the plug body to form a gripping circle around cords of various sizes. Each gripping jaw is attached to the next jaw with a fastener so that the jaws can be moved together and held tight against the cord when the plug is in use. Thus the plug may be internally secured to the cord irrespective of the cord diameter.

The internal environmental cord seal consists of a notched rubber bushing formed between two rings. The internal environmental seal is located between the internal adjustable gripping means and the cover. As the cover is tightened over the clamping jaws, the rings on either side of the rubber bushing are urged together thus causing the notched rubber bushing to collapse inwardly, thus sealing the cord against the affects of weather.

Also provided on the rings of the cord seal are a series of mating surfaces which, when interacting with the inside of the cover and the jaw surfaces, both lock the seal assembly in place and increase torque needed to remove the cover and while allow the bushing to return to its pre-collapsed position. This internal interaction of surfaces provides both ease of use and secure mounting.

BRIEF DESCRIPTION OF THE FIGURES

A better understanding of the present invention may be had by reference to the drawings wherein:

FIG. 4 is a top view, partially in section showing the gripping arrangement that is the subject of the present invention;

FIG. 5 is a top view, partially in section showing the gripping arrangement;

FIG. 6 is a top view, partially in section showing the gripping arrangement;

FIG. 7 is a side view, partially in section showing the gripping arrangement;

DETAILED DESCRIPTION OF A PREFERRED EMBODIMENT

Figure 1:
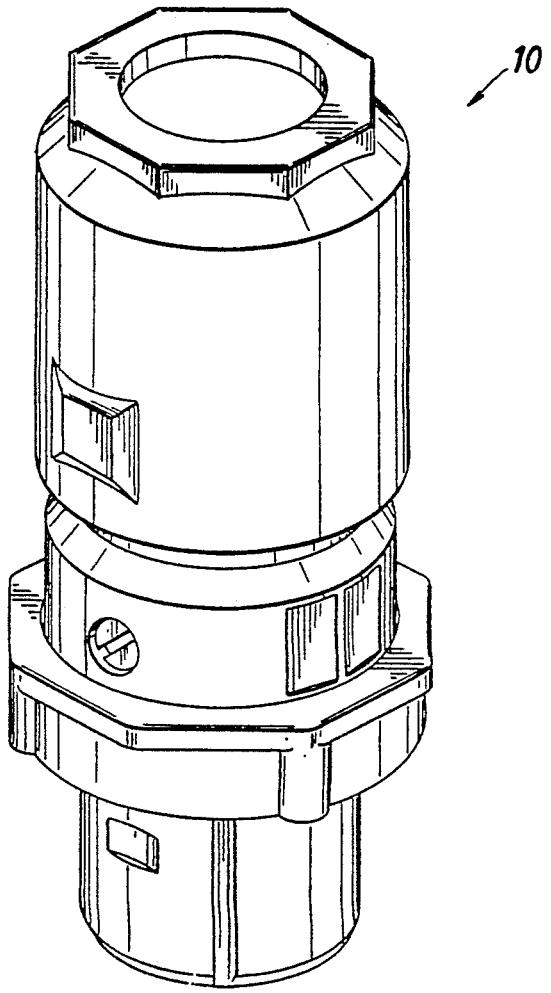
FIG. 1 is a perspective view showing the electrical plug assembly that is the subject of the present invention.
Figure 2:
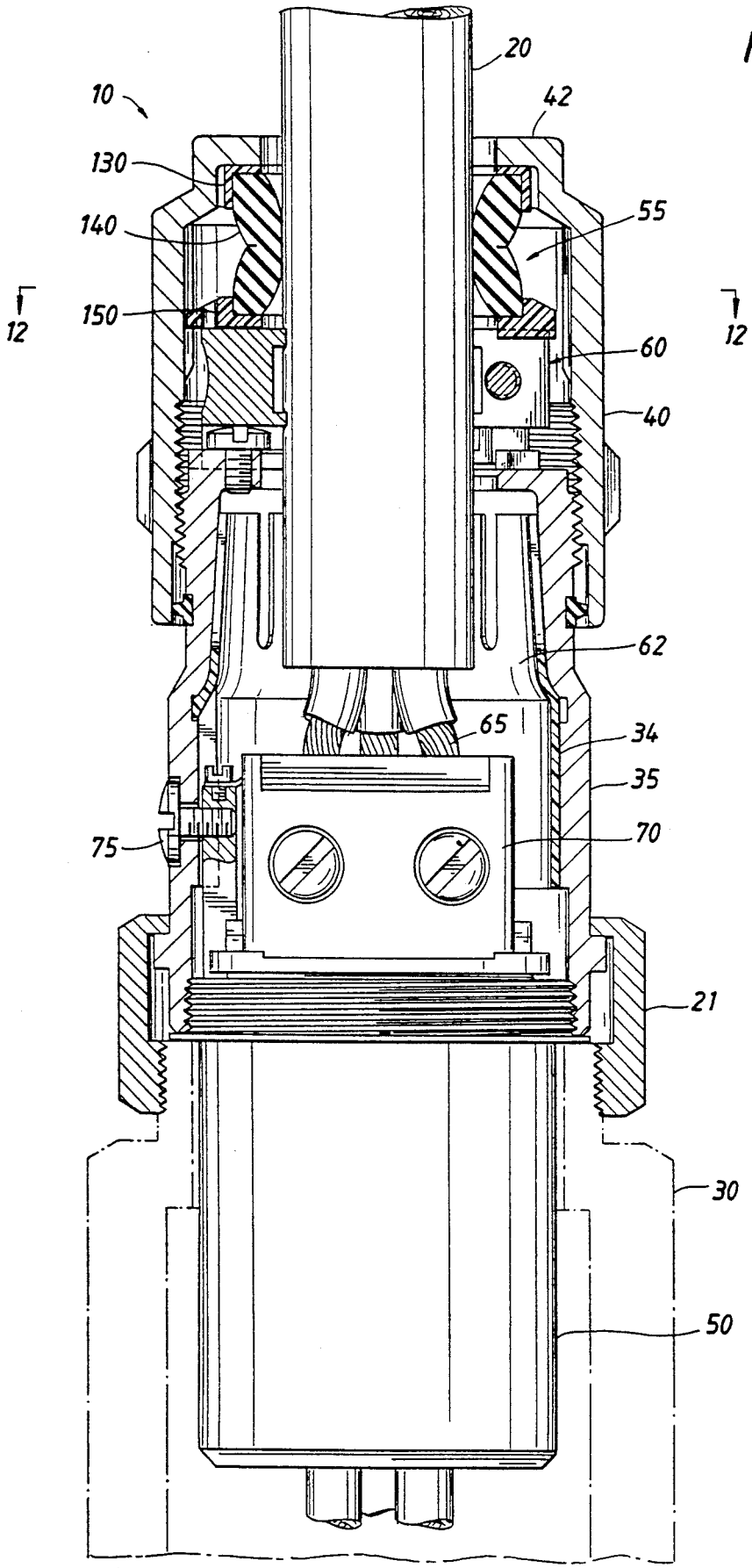
FIG. 2 is a section view showing the electrical plug and a mating receptacle.

The present invention can best be understood by reference to the Figures. FIG. 1 is a perspective view of the electrical plug 10 of the present invention. FIG. 2 is a side view, partially in section of the electrical plug 10. An electrical cord 20 extends from one end of the plug 10 and typically runs to a portable, electrically powered machine like a welder (not shown). At its opposite end, the plug 10 mates with an electrical receptacle 30 which provides electrical energy (shown with dotted lines) and is held at the receptacle with locking nut 21. The plug 10 consists of three exposed parts: a body 35; a cover 40; and a sleeve 50.

After entering through the cover 40, the cord 20 extends through a sealing assembly 55 consisting of a bushing 140 and two rings 130, 150 where the cord 20 is environmentally sealed to prevent the introduction of water, dirt, fumes or other foreign materials into the plug 10. The cord 20 then extends through a cord gripping assembly 60 where it is held securely to prevent the cord 20 from separating from the plug 10. As the cord 20 passes into body 35 it passes through an insulator 62 which prevents the conductors 65 from coming into contact with the inside wall 34 of body 35. Inside the plug body 35, conductors 65 terminate into a contact assembly 70 where they are mechanically and electrically connected to corresponding prongs (not shown). The electrical prongs are housed in sleeve 50 which is threaded onto the plug body 35 and held in place by set screw 75.

Sleeve 50 is equipped with a key way 51 (FIG. 3) to ensure its insertion into the receptacle in a certain orientation. The contact assembly 70 could be equipped with a polarization arrangement whereby the prongs of a plug with a given wiring arrangement would be rotated a number of degrees from the vertical. By having a matching polarization arrangement in the prong sockets of the receptacle, the inadvertent insertion of a plug into a receptacle with matching prongs but a different wiring arrangement could be avoided.

Figure 3:
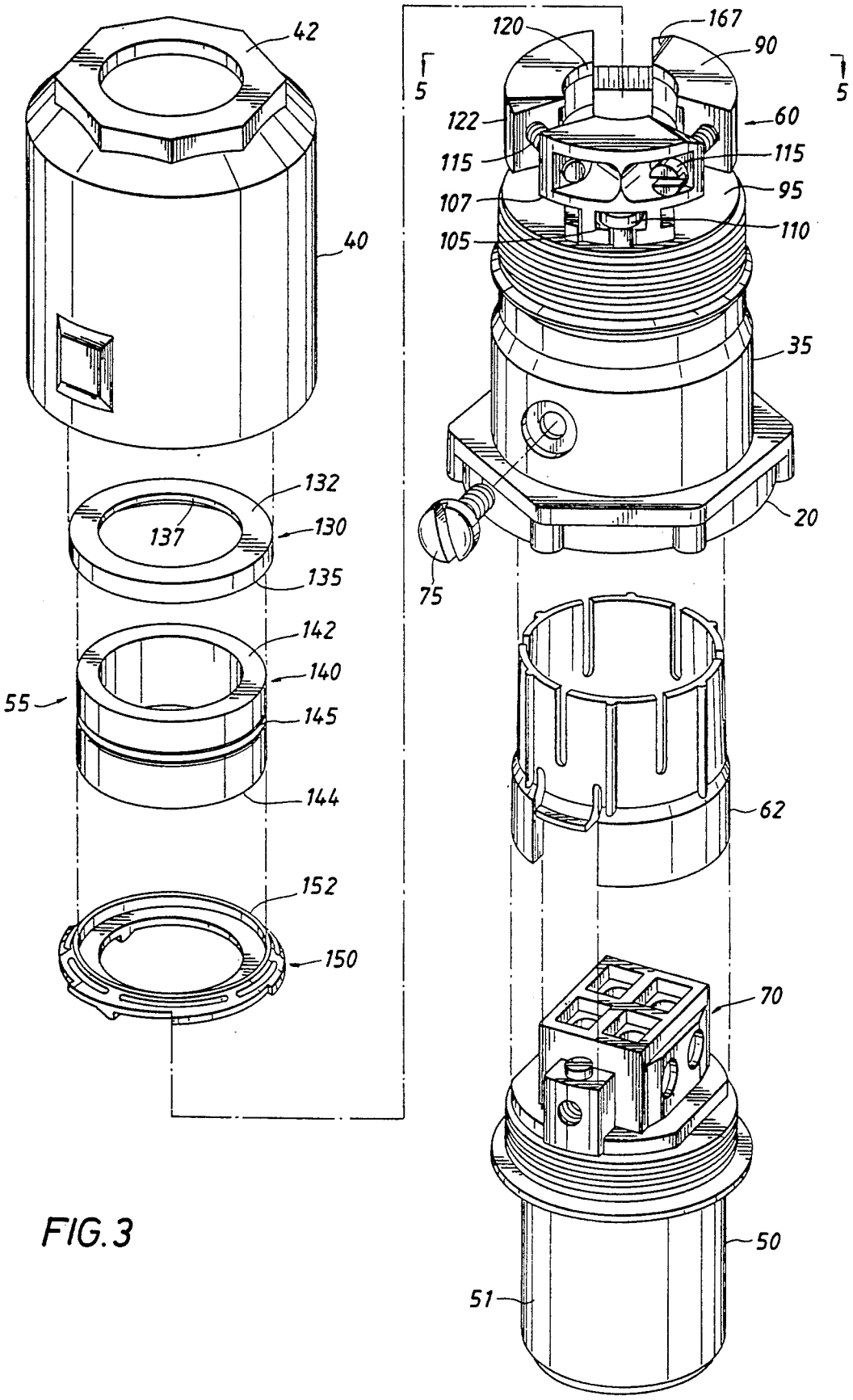
FIG. 3 is an exploded view showing the electrical plug.

FIG. 3 is an exploded view showing the aforementioned parts and how they are assembled together.

GRIPPING ASSEMBLY

As depicted in FIGS. 2 and 3, the three-jaw cord gripping assembly 60 fits within cover 40 to firmly grasp electrical cord 20, and prevent pulling forces from being transmitted to the contact assembly 70 where the cord 20 terminates into the contact assembly 70.

As shown in FIG. 3, the gripping assembly 60 consists of three jaws 90 radially spaced about a first end 95 of the plug body 35. Each jaw 90 has a concave radius curve 120 at the inside and a convex radius curve 122 at the outside. Each jaw 90 slides towards and away from the center of the plug body 35 to grip cord 20. The sliding action is accomplished by a channel 105 formed at the bottom 107 of each jaw 90. Channel 105 fits over a screw head 110 on the first end 95 of plug body 35. In the preferred embodiment, the channel 105 is arranged in a manner particular to the 60 amp plug. The physical arrangement of the jaw-channel interface for the larger 100 amp plug and the smaller 30 amp plug is different to prevent the accidental installation of the jaws onto the wrong size plug body.

The jaws 90 are attached to each other by fasteners 115 which connect one jaw 90 to the next jaw. By turning the fasteners 115, the jaws 90 are pulled along their channels 105 towards or away from the center of the plug body 35. In addition to allowing for adjustment, the fasteners 115 allow the gripping assembly 60 to be tightened in place against cord 20.

FIGS. 4, 5 and 6 depict the gripping assembly 60 in different positions. In FIG. 4 the jaws 90 are shown in the position they would occupy when gripping the largest cord 20. One jaw 90 is completely removed for clarity. Even when gripping the largest cords 20, the outside diameter of the gripping assembly 60 remains smaller than the outside diameter of the first end 95 of plug body 35, assuring that cover 40 can be replaced even with the largest cord 20 in use. Jaws 90 can be fully extended beyond the outside diameter of the plug body 35 for the purpose of inserting the largest cord 20.

FIG. 5 depicts the gripping assembly 60 in use with a medium diameter cord 20. The threaded fasteners 115 allow the jaws 90 to be pulled together simultaneously and remain a common distance from each other and from the center of the plug body 35. Finally, FIG. 6 depicts the gripping assembly 60 as it would appear when used with the smallest diameter cord 20. The jaws 90 have pulled together to form near-circular shapes with their inside and outside diameters.

While the gripping assembly 60 of the preferred embodiment consists of three jaws 90, it will be understood by those skilled in the art that the gripping assembly 60 could use any number of jaws 90 of any configuration so long as the assembly allows adjustment of the jaws 90 and operates within the confines of a cover 40 and the diameter of the plug body 35. For example, the jaws could operate like the jaws of a Jacobs chuck where the jaws move upwards and downwards as they open and close. Additionally, the slides 105 allowing the jaws to move forward and away from the center of the plug body 35 cold be of a variety of designs and remain within the scope of the invention. For example, the screw head 110 which acts with the jaw channels 105 to facilitate sliding could be integrally formed into the plug body 35. Also, the fasteners 115 which connect the jaws 90 to one another could attach each jaw 90 directly to the plug body 35 and still be within the scope of the invention.

SEAL ASSEMBLY

As depicted in FIG. 2, the seal assembly 55 fits between the end 42 of cover 40 and the gripping assembly 60. As depicted in FIG. 3, the seal assembly 55 consists of notched bushing 140, slip ring 130 and torque ring 150. Slip ring 130 includes a downward facing flange 135 which fits over the top surface 142 of the bushing 140. Torque ring 150 also has a flange 152 allowing it to fit over the end surface 144 of the bushing 140 opposite the slip ring 130. In the preferred embodiment, the rings 130, 150 are made of a hard, molded plastic but could be made of any material that provides some flexibility like a polymer, hard rubber or even aluminum.

The seal assembly 55 operates when cover 40 is threaded onto plug body 35. As the cover 40 is threaded onto the body 35, the upper surface 132 of slip ring 130 seals against a raised circular line in the interior of cover 40 (not shown). The lower surface 137 of seal ring 130 is forced against the top surface 142 of bushing 140, which becomes compressed between rings 130 and 150. Bushing 140, made of rubber or some other resilient material like foam or an elastomer, has a notch 145 formed in its outer perimeter. As bushing 140 is compressed between rings 130 and 150, the notch 145 causes the bushing 140 to collapse inwardly against the cord 20, sealing the cord 20 from the environment.

Figure 8:
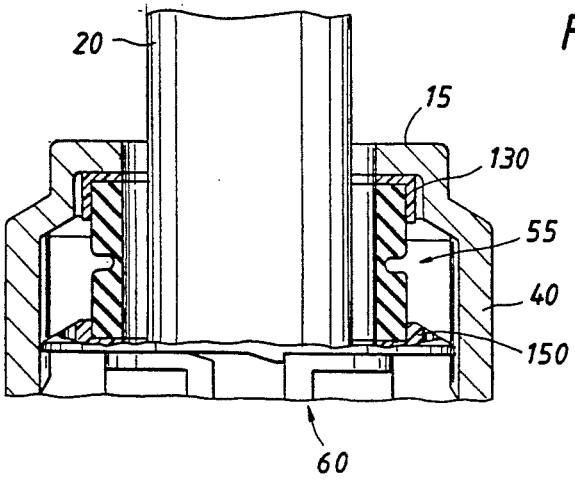
FIG. 8 is a side view, partially in section, showing the sealing arrangement that is the subject of the present invention.
Figure 9:
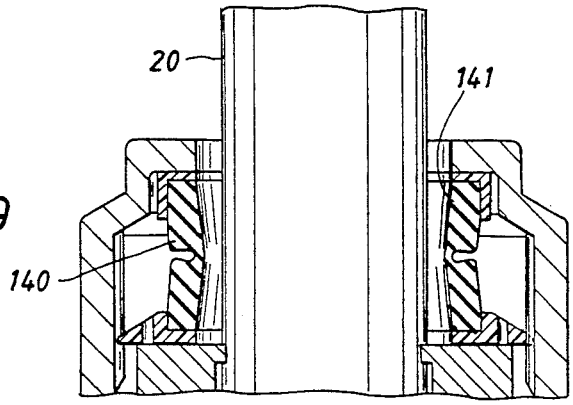
FIG. 9 is a side view depicting the sealing arrangement closed around an electrical cord.
Figure 10:
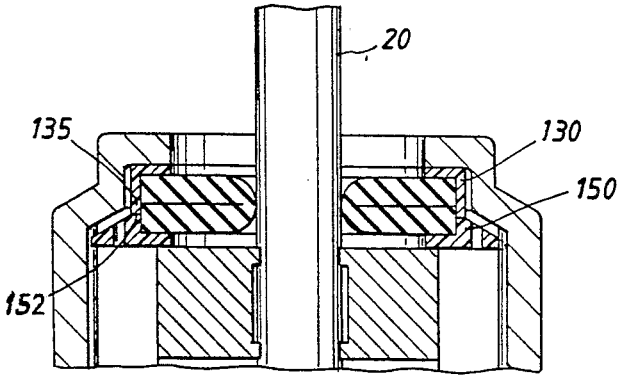
FIG. 10 is a side view depicting the sealing arrangement closed around a smaller diameter electrical cord.

FIG. 8 shows the seal assembly 55 in place with the gripping assembly 60 tightened around cord 20. In FIG. 8, the cover 40 has not yet been threaded onto body 35 to compress seal assembly 55. FIG. 9 shows the seal assembly 55 with a cord 20 of medium diameter. Bushing 140 has been compressed between rings 130 and 150 as the cover 40 has been threaded onto the plug body 35 (not shown). In FIG. 9, the wall 141 of bushing 140 has begun to collapse to encircle and seal cord 20. FIG. 10 depicts the sealing assembly 55 collapsed around a cord 20 of the smallest diameter. Bushing 140 has collapsed inward until the flange 135 of slip ring 130 meets the flange 152 of torque ring 150.

Because the integrity of the sealing assembly 55 in the present invention depends upon the cover 40 remaining tightly threaded to the body 35, the seal assembly 55 of the present invention also provides a locking action to both prevent the torque ring 150 from moving in a counterclockwise motion and a means to increase the torque required to remove cover 40. The locking and torque increasing means includes a series of inclined surfaces located on the torque ring 150, cover 40 and jaws 90. While the preferred embodiment includes a torque increasing and torque ring locking means, it will be understood by those skilled in the art that the sealing assembly 55 of the present invention will operate alone as well as with a torque increasing and locking means.

Figure 11:
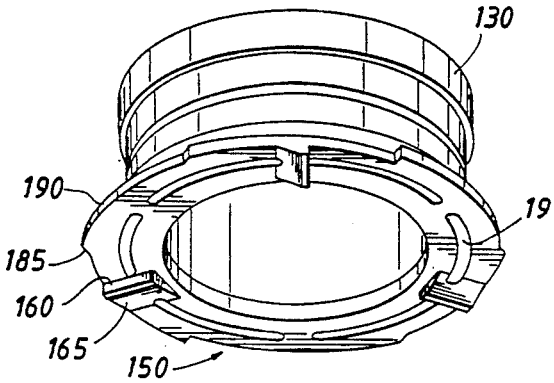
FIG. 11 is a perspective view, showing the underside of the torque ring that is the subject of the present invention.

As depicted in FIG. 11, the bottom of torque ring 150 includes a number of sloped surfaces 165 and walls 160. Additionally, as shown in FIG. 3, each jaw 90 of gripping assembly 60 has an inclined surface 167 on its leading edge. The relation between the surfaces is depicted in FIG. 7. As the cover 40 is threaded onto the body 35 in a clockwise motion, the sloped surfaces 165 of the torque ring easily slip over the inclined surfaces 176 of the jaws allowing the torque ring 150 to rotate on the jaws 90 as the seal assembly 55 is compressed. However, when the cover 40 is loosened in a counterclockwise motion, the wall 160 acts against the trailing edge of jaw 90 which has no inclined surface. The result as depicted in FIG. 7 is a locking action which prevents the counterclockwise movement of torque ring 150.

Figure 12:
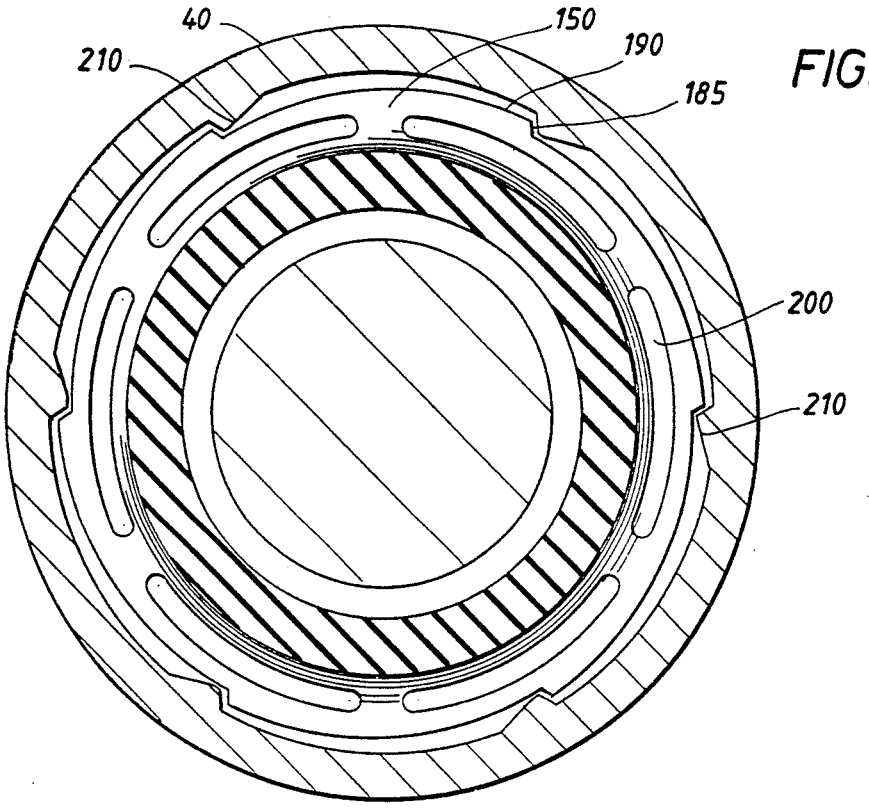
FIG. 12 is a top view of the sealing assembly with the torque ring in the normal position.
Figure 13:
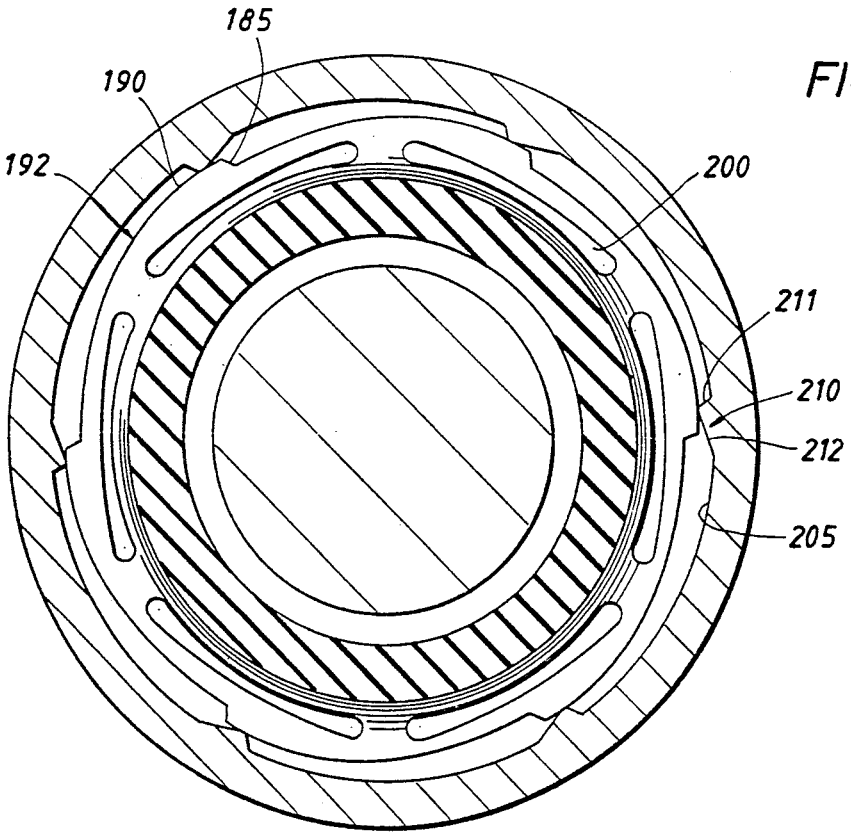
FIG. 13 is a top view of the sealing assembly showing the torque ring in the stressed position.

Means for increasing the torque to remove the cover 40 are depicted in FIGS. 12 and 13. Steep slopes 185 and gradual slopes 190 are formed on the outside edge 192 of torque ring 150. The inside 205 of cover 40 includes several longitudinal ridges 210, each having a steep 211 and a shallow side 212. As cover 40 is threaded onto the body 35 in a clockwise direction, the gradual slope 190 of the torque ring 150 slides across the shallow side 212 of ridge 210, allowing the cover 40 to be tightened with minimum torque (FIG. 12). However, to remove cover 40, the steep slope 185 of torque ring 150 must slide across the steep side 211 of ridge 210 (FIG. 13). Torque ring 150 includes slots 200 which cause torque ring 150 to temporarily deform inward thus allowing the steep slope 185 of the torque ring to move counterclockwise across ridge 210.

In use, the plug 10 of the present invention is attached to an electrical cord 20 by first preparing the cord 20 by stripping away the covering and exposing the individual conductors of the cord 20. The sleeve 50 and the cover 40 are then un-threaded from the plug body 35. Next, the prepared cord is inserted through the cover 40, the seal assembly 55 and the plug body 35 and the conductors 65 are terminated into the prongs of the plug 10. The body 35 is then threaded onto the sleeve 50 and the adjustable gripping means 60 is tightened around the cord 20. Finally, the cover 40 is threaded back onto the body 35, compressing and energizing the cord seal 55.

While the sealing assembly 55 of the preferred embodiment utilizes a notched bushing 140, it will be understood by those skilled in the art that the bushing could be of any design so long as it collapses inwardly to seal against cord 20. Additionally, the locking and torque increasing means could be accomplished with a variety of different inclined surfaces and is not limited to the particular combination of surfaces described in the preferred embodiment. Further, while the jaws of the gripping mechanism in the preferred embodiment include inclined surfaces to act with the seal assembly, the seal assembly with its locking and torque increasing feature is not limited to use with any particular gripping arrangement and could be used without an internal cord gripping means.

While the electrical plug assembly of the present invention has been described by reference to its preferred embodiment, it will be understood that other various embodiments of the device and method of the present invention may be possible by reference to the specification and the appended claims. Such additional embodiments shall be included within the scope of the appended claims.

I claim:

1. A plug assembly for connection to an electrical cord, said plug assembly comprising:

a hollow body, said hollow body having first and second ends and constructed and arranged to house the electrical cord;

means for terminating the electrical cord by connection to a plurality of prongs, said prongs being located on said first end of said hollow body, said means for terminating the electrical cord being enclosed entirely within said hollow body;

a hollow cover, said hollow cover constructed and arranged to enclose said second end of said hollow body, said hollow cover constructed and arranged to allow the electrical cord to pass therethrough;

adjustable means for gripping the electrical cord at said second end of said hollow body, said adjustable means for gripping including:

a plurality of jaws radially spaced around the center of said second end of said hollow body;

means for sliding said jaws towards and away from the center of said hollow body, said means for sliding operating independent of said cover;

means for securing said jaws against the electrical cord, said means for securing operating independent of said cover;

whereby said means for gripping fits within said hollow cover when said cover encloses said second end of said body; and adjustable means for sealing around the electrical cord at the second end of said hollow body whereby said adjustable means for sealing fits within said hollow cover when said cover encloses said second end of said body.

2. The plug assembly as defined in claim 1, wherein said means for sliding said jaws includes:

a slide integrally formed on the surface of each jaw adjacent to said second end of said hollow body, said slide including two legs, each of said legs having an inwardly facing flange whereby said legs form a slotted slide path along said surface, said slotted slide path is constructed and arranged to act in concert with a guide member to provide sliding movement of said jaws, said guide members located radially around said center of said second end of said hollow body.

3. The plug assembly as defined in claim 2, wherein said means for securing said jaws includes:

a plurality of threaded fasteners connecting each of said jaws; whereby a first fastener extends from a first jaw to a second jaw and a second fastener extends from said second jaw to a third jaw; whereby said jaws are urged together and moved inward or outward along said slotted slide path as said fasteners are turned.

4. The plug assembly as defined in claim 3, wherein the side of said jaw adjacent to the electrical cord has a concave radius substantially corresponding to the curvature of the electrical cord.

5. The plug assembly as defined in claim 4 wherein there are three jaws.

6. The plug assembly as defined in claim 1, wherein said means for sealing around the electrical cord includes a bushing assembly, said bushing assembly including:

a flexible compression bushing constructed and arranged so that the wall of said flexible compression bushing, when compressed, moves inwardly to reduce the inside diameter of said flexible compression bushing and forming a seal around the electrical cord.

7. The plug assembly as defined in claim 6, wherein said bushing assembly further includes:

a slip ring having a flange around its outer perimeter, whereby said flexible compression bushing may be disposed within said slip ring;

a torque ring having a flange around its outer perimeter, whereby said flexible compression bushing may be disposed within said torque ring;

said bushing assembly constructed and arranged to be compressed inwardly by said slipping and torque ring as said hollow cover is attached to said hollow plug body.

8. The plug assembly as defined in claim 6, whereby said flexible compression bushing includes a notch in its outer perimeter.

9. The plug assembly as defined in claim 8, whereby said bushing assembly is compressed between said means for gripping the electrical cord and the end of said hollow cover opposite said hollow body.

10. The plug assembly as defined in claim 9, wherein said means for sealing further includes a raised sealing ring formed around the inside of said hollow cover opposite said hollow body, said raised sealing ring constructed and arranged to act against said slip ring and form a seal in the area between said slip ring and said hollow cover.

11. The plug assembly as defined in claim 10, further including means for preventing rotation of said torque ring after said hollow cover has been tightened onto said hollow body and said flexible compression bushing has sealed against the electrical cord, said means for preventing rotation including:

a plurality of ramps formed on the bottom surface of said torque ring, said ramps having an inclined surface and a surface perpendicular to said bottom surface of said torque ring;

a downwardly slanting surface formed on said jaws adjacent to said torque ring;

whereby said inclined surfaces of said torque ring slide across said downwardly slanting surfaces of said jaws as said torque ring is turned and;

whereby said perpendicular surfaces of said ramps on said torque ring contact trailing edge of said jaws as said torque ring is turned in an opposite direction thereby preventing the rotation of said torque ring.

12. The plug assembly defined in 11, further including:

means for increasing torque required to remove said hollow cover from said hollow body after said flexible compression bushing has been compressed and sealed around the electrical cord, said means for increasing torque include:

a plurality of steep and gradual slopes formed on the perimeter of said torque ring;

a plurality of substantially curved slots formed in the bottom of said torque ring adjacent to said jaws, said curved slots constructed and arranged to allow said torque ring to deform inwardly;

a plurality of longitudinal ridges formed on the inside wall of said hollow cover, said longitudinal ridges including a steep side and a shallow side;

whereby said gradual slopes of said torque ring slide across said shallow side of said ridges as said torque ring is turned in one direction allowing said hollow cover to be threadably attached onto said hollow body and said flexible compression bushing to be compressed; and whereby said steep slopes of said torque ring contact said steep side of said ridges as said torque ring is moved in the opposite direction causing said torque ring to deform inwardly as said hollow cover is removed from said hollow body thereby increasing the torque required to remove said hollow cover from said hollow body and allowing said flexible compression bushing to return to its pre-compressed state.

13. A plug assembly for connection to an electrical cord, said plug assembly comprising:

a hollow body, said hollow body having first and second ends and constructed and arranged to house the electrical cord;

means for terminating the electrical cord by connection to a plurality of prongs, said prongs being located on said first end of said hollow body, said means for terminating the electrical cord being enclosed entirely within said hollow body;

a hollow cover, said hollow cover constructed and arranged to enclose said second end of said hollow body, said hollow cover constructed and arranged to allow the electrical cord to pass therethrough; and adjustable means for gripping the electrical cord at said second end of said hollow body, said adjustable means for gripping including:

a plurality of jaws radially spaced around the center of said second end of said hollow body;

means for sliding said jaws towards and away from the center of said hollow body, said means for sliding operating independent of said cover;

means for securing said jaws against the electrical cord, said means for securing operating independent of said cover;

whereby said means for gripping fits within said hollow cover when said cover encloses said second end of said body.

14. The plug assembly defined in claim 13, wherein said means for sliding said jaws includes:

a slide integrally formed on the surface of each jaw adjacent to said second end of said hollow body, said slide including two legs, each of said legs having an inwardly facing flange whereby said legs form a slotted slide path along said surface, said slotted slide path is constructed and arranged to act in concert with a guide member to provide sliding movement of said jaws, said guide members located radially around said center of said second end of said hollow body.

15. The plug assembly as defined in claim 14, wherein said means for securing said jaws includes:

a plurality of threaded fasteners connecting each of said jaws; whereby a first fastener extends from a first jaw to a second jaw and a second fastener extends from said second jaw to a third jaw; whereby said jaws are urged together and moved inward or outward along said slotted slide path as said fasteners are turned.

16. The plug assembly as defined in claim 15, wherein the side of said jaw adjacent to the electrical cord has a concave radius substantially corresponding to the curvature of the electrical cord.

17. The plug assembly as defined in claim 16 wherein there are three jaws.

18. A plug assembly for connection to an electrical cord, said plug assembly comprising:

a substantially hollow body having first and second ends and constructed and arranged to house the electrical cord;

a sleeve having first and second ends, said first end in threaded relationship with said first end of said body;

a contact assembly at the first end of said sleeve, said contact assembly having a plurality of prongs, said prongs insertable into a receptacle with means for electrical connection of the cord to said prongs;

a hollow cover, said hollow cover constructed and arranged to enclose said second end of said hollow body, said hollow cover constructed and arranged to allow the electrical cord to pass therethrough;

a circular coupling nut extending around the first end of said body, said circular coupling nut constructed and arranged to provide mechanical attachment between said plug assembly and said receptacle;

adjustable mans for gripping the electrical cord at said second end of said hollow body, said adjustable means for gripping including:

a plurality of jaws radially spaced around the center of said second end of said hollow body;

means for sliding said jaws towards and away from the center of said hollow body, said means for sliding operating independent of said cover;

means for securing said jaws against the electrical cord, said means for securing operating independent of said cover;

whereby said means for gripping fits within said hollow cover when said cover encloses said second end of said body; and adjustable means for sealing around the electrical cord at the second end of said body whereby said means for sealing fits within said hollow cover when said cover encloses said second end of said body.

19. The plug assembly as defined in claim 18, wherein said means for sliding said jaws includes:

a slide integrally formed on the surface of each jaw adjacent to said second end of said hollow body, said slide including two legs, each of said legs having an inwardly facing flange whereby said legs form a slotted slide path along said surface, said slotted slide path is constructed and arranged to act in concert with a guide member to provide sliding movement of said jaws, said guide members located radially around said center of said second end of said hollow body.

20. The plug assembly as defined in claim 19, wherein said means for securing said jaws includes:

a plurality of threaded fasteners connecting each of said jaws; whereby a first fastener extends from a first jaw to a second jaw and a second fastener extends from said second jaw to a third jaw; whereby said jaws are urged together and moved inward or outward along said slotted slide path as said fasteners are turned.

21. The plug assembly as defined in claim 20, wherein the side of said jaw adjacent to the electrical cord has a concave radius substantially corresponding to the curvature of the electrical cord.

22. The plug assembly as defined in claim 21, wherein there are three jaws.

23. The plug assembly as defined in claim 18, wherein said means for sealing around the electrical cord includes a bushing assembly, said bushing assembly including:

a flexible compression bushing constructed and arranged so that the wall of said flexible compression bushing, when compressed, moves inwardly to reduce the inside diameter of said flexible compression bushing and forming a seal around the electrical cord.

24. The plug assembly as defined in claim 23, wherein said bushing assembly further includes:

a slip ring having a flange around its outer perimeter, whereby said flexible compression bushing may be disposed within said slip ring;

a torque ring having a flange around its outer perimeter, whereby said flexible compression bushing may be disposed within said torque ring;

said bushing assembly constructed and arranged to be compressed inwardly by said slipping and torque ring as said hollow cover is attached to said hollow plug body.

25. The plug assembly as defined in claim 24, whereby said flexible compression bushing includes a notch in its outer perimeter.

26. The plug assembly as defined in claim 25, whereby said bushing assembly is compressed between said means for gripping the electrical cord and the end of said hollow cover opposite said hollow body.

27. The plug assembly as defined in claim 26, wherein said means for sealing further includes a raised sealing ring formed around the inside of said hollow cover opposite said hollow body, said raised sealing ring constructed and arranged to act against said slip ring and form a seal in the area between said slip ring and said hollow cover.

28. The plug assembly as defined in claim 27, further including means for preventing rotation of said torque ring after said hollow cover has been tightened onto said hollow body and said flexible compression bushing has sealed against the electrical cord, said means for preventing rotation including:

a plurality of ramps formed on the bottom surface of said torque ring, said ramps having an inclined surface and a surface perpendicular to said bottom surface of said torque ring;

a downwardly slanting surface formed on said jaws adjacent to said torque ring;

whereby said inclined surfaces of said torque ring slide across said downwardly slanting surfaces of said jaws as said torque ring is turned and;

whereby said perpendicular surfaces of said ramps on said torque ring contact trailing edge of said jaws as said torque ring is turned in an opposite direction thereby preventing the rotation of said torque ring.

29. The plug assembly defined in 28, further including:

means for increasing torque required to remove said hollow cover from said hollow body after said flexible compression bushing has been compressed and sealed around the electrical cord, said means for increasing torque include:

a plurality of steep and gradual slopes formed on the perimeter of said torque ring;

a plurality of substantially curved slots formed in the bottom of said torque ring adjacent to said jaws, said curved slots constructed and arranged to allow said torque ring to deform inwardly;

a plurality of longitudinal ridges formed on the inside wall of said hollow cover, said longitudinal ridges including a steep side and a shallow side;

whereby said gradual slopes of said torque ring slide across said shallow side of said ridges as said torque ring is turned in one direction allowing said hollow cover to be threadably attached onto said hollow body and said flexible compression bushing to be compressed; and whereby said steep slopes of said torque ring contact said steep side of said ridges as said torque ring is moved in the opposite direction causing said torque ring to deform inwardly at said hollow cover is removed from said hollow body thereby increasing the torque required to remove said hollow cover from said hollow body and allowing said flexible compression bushing to return to its pre-compressed state.

30. A system for supplying electric power to a machine, said system comprising:

an electrical cord, said cord including a plurality of conductors;

an electrical plug, said plug including:

a hollow body, said hollow body having first and second ends and constructed and arranged to house the electrical cord;

means for terminating the electrical cord by connection to a plurality of prongs, said prongs being located on said first end of said hollow body, said means for terminating the electrical cord being enclosed entirely within said hollow body;

a hollow cover, said hollow cover constructed and arranged to enclose said second end of said hollow body, said hollow cover constructed and arranged to allow the electrical cord to pass therethrough;

adjustable means for gripping the electrical cord at said second end of said hollow body, said adjustable means for gripping including:

a plurality of jaws radially spaced around the center of said second end of said hollow body;

means for sliding said jaws towards and away from the center of said hollow body, said means for gripping operating independent of said cover;

means for securing said jaws against the electrical cord, said means for securing operating independent of said cover;

whereby said means for gripping fits within said hollow cover when said cover encloses said second end of said body; and adjustable means for sealing around the electrical cord at the second end of said body whereby said adjustable means for sealing fits within said hollow cover when said cover encloses said second end of said body.

31. The system as defined in claim 30, wherein said means for sliding said jaws includes:

a slide integrally formed on the surface of each jaw adjacent to said second end of said hollow body, said slide including two legs, each of said legs having an inwardly facing flange whereby said legs form a slotted slide path along said surface, said slotted slide path is constructed and arranged to act in concert with a guide member to provide sliding movement of said jaws, said guide members located radially around said center of said second end of said hollow body.

32. The system as defined in claim 31, wherein said means for securing said jaws includes:

a plurality of threaded fasteners connecting each of said jaws; whereby a first fastener extends from a first jaw to a second jaw and a second fastener extends from said second jaw to a third jaw; whereby said jaws are urged together and moved inward or outward along said slotted slide path as said fasteners are turned.

33. The system as defined in claim 32, wherein the side of said jaw adjacent to the electrical cord has a concave radius substantially corresponding to the curvature of the electrical cord.

34. The system as defined in claim 33 wherein there are three jaws.

35. The system as defined in claim 30, wherein said means for sealing around the electrical cord includes a bushing assembly, said bushing assembly including:

a flexible compression bushing constructed and arranged so that the wall of said flexible compression bushing, when compressed, moves inwardly to reduce the inside diameter of said flexible compression bushing and forming a seal around the electrical cord.

36. The system as defined in claim 35, wherein said bushing assembly further includes:

a slip ring having a flange around its outer perimeter, whereby said flexible compression bushing may be disposed within said slip ring;

a torque ring having a flange around its outer perimeter, whereby said flexible compression bushing may be disposed within said torque ring;

said bushing assembly constructed and arranged to be compressed inwardly by said slipping and torque ring as said hollow cover is attached to said hollow plug body.

37. The system as defined in claim 36, whereby said flexible compression bushing includes a notch in its outer perimeter.

38. The system as defined in claim 37, whereby said bushing assembly is compressed between said means for gripping the electrical cord and the end of said hollow cover opposite said hollow body.

39. The system as defined in claim 38, wherein said means for sealing further includes a raised sealing ring formed around the inside of said hollow cover opposite said hollow body, said raised sealing ring constructed and arranged to act against said slip ring and form a seal in the area between said slip ring and said hollow cover.

40. The system as defined in claim 39, further including means for preventing rotation of said torque ring after said hollow cover has been tightened onto said hollow body and said flexible compression bushing has sealed against the electrical cord, said means for preventing rotation including:

a plurality of ramps formed on the bottom surface of said torque ring, said ramps having an inclined surface and a surface perpendicular to said bottom surface of said torque ring;

a downwardly slanting surface formed on said jaws adjacent to said torque ring;

whereby said inclined surfaces of said torque ring slide across said downwardly slanting surfaces of said jaws as said torque ring is turned and;

whereby said perpendicular surfaces of said ramps on said torque ring contact trailing edge of said jaws as said torque ring is turned in an opposite direction thereby preventing the rotation of said torque ring.

41. The system defined in claim 40, further including:

means for increasing torque required to remove said hollow cover from said hollow body after said flexible compression bushing has been compressed and sealed around the electrical cord, said means for increasing torque include:

a plurality of steep and gradual slopes formed on the perimeter of said torque ring;

a plurality of substantially curved slots formed in the bottom of said torque ring adjacent to said jaws, said curved slots constructed and arranged to allow said torque ring to deform inwardly;

a plurality of longitudinal ridges formed on the inside wall of said hollow cover, said longitudinal ridges including a steep side and a shallow side;

whereby said gradual slopes of said torque ring slide across said shallow side of said ridges as said torque ring is turned in one direction allowing said hollow cover to be threadably attached onto said hollow body and said flexible compression bushing to be compressed; and wherein said steep slopes of said torque ring contact said steep side of said ridges as said torque ring is moved in the opposite direction causing said torque ring to deform inwardly as said hollow cover is removed from said hollow body thereby increasing the torque required to remove said hollow cover from said hollow body and allowing said flexible compression bushing to return to its pre-compressed state.

42. A portable electrical machine, said machine comprising:

a device for utilizing electrical power to perform work; an electrical cord for transporting said power to said machine; and an electrical plug for connecting said machine and cord to an electrical receptacle, said plug including:

a hollow body, said hollow body having first and second ends and constructed and arranged to house the electrical cord;

means for terminating the electrical cord by connection to a plurality of prongs, said prongs being located on said first end of said hollow body, said means for terminating the electrical cord being enclosed entirely within said hollow body;

a hollow cover, said hollow cover constructed and arranged to enclose said second end of said hollow body, said hollow cover constructed and arranged to allow the electrical cord to pass therethrough;

adjustable means at said second end of said hollow body for gripping the electrical cord, said adjustable means for gripping including:

a plurality of jaws radially spaced around the center of said second end of said hollow body;

means for sliding said jaws towards and away from the center of said hollow body, said means for sliding operating independent of said cover;

means for securing said jaws against the electrical cord, said means for securing operating independent of said cover;

whereby said means for gripping fits within said hollow cover when said cover encloses said second end of said body; and adjustable means for sealing around the electrical cord at the second end of said body whereby said adjustable means for sealing fits within said hollow cover when said cover encloses said second end of said body.

43. The machine as defined in claim 42, wherein said means for sliding said jaws includes:

a slide integrally formed on the surface of each jaw adjacent to said second end of said hollow body, said slide including two legs, each of said legs having an inwardly facing flange whereby said legs form a slotted slide path along said surface, said slotted slide path is constructed and arranged to act in concert with a guide member to provide sliding movement of said jaws, said guide members located radially around said center of said second end of said hollow body.

44. The machine as defined in claim 43, wherein said means for securing said jaws includes:

a plurality of threaded fasteners connecting each of said jaws; whereby a first fastener extends from a first jaw to a second jaw and a second fastener extends from said second jaw to a third jaw; whereby said jaws are urged together and moved inward or outward along said slotted slide path as said fasteners are turned.

45. The machine as defined in claim 44, wherein the side of said jaw adjacent to the electrical cord has a concave radius substantially corresponding to the curvature of the electrical cord.

46. The machine as defined in claim 45 wherein there are three jaws.

47. The machine as defined in claim 42, wherein said means for sealing around the electrical cord includes a bushing assembly, said bushing assembly including:

a flexible compression bushing constructed and arranged so that the wall of said flexible compression bushing, when compressed, moves inwardly to reduce the inside diameter of said flexible compression bushing and forming a seal around the electrical cord.

48. The machine as defined in claim 47, wherein said bushing assembly further includes:

a slip ring having a flange around its outer perimeter, whereby said flexible compression bushing may be disposed within said slip ring;

a torque ring having a flange around its outer perimeter, whereby said flexible compression bushing may be disposed within said torque ring;

said bushing assembly constructed and arranged to be compressed inwardly by said slip ring and torque ring as said hollow cover is attached to said hollow plug body.

49. The machine as defined in claim 48, whereby said flexible compression bushing includes a notch in its outer perimeter.

50. The machine as defined in claim 49, whereby said bushing assembly is compressed between said means for gripping the electrical cord and the end of said hollow cover opposite said hollow body.

51. The machine as defined in claim 50, wherein said means for sealing further includes a raised sealing ring formed around the inside of said hollow cover opposite said hollow body, said raised sealing ring constructed and arranged to act against said slip ring and form a seal in the area between said slip ring and said hollow cover.

52. The machine as defined in claim 51, further including means for preventing rotation of said torque ring after said hollow cover has been tightened onto said hollow body and said flexible compression bushing has sealed against the electrical cord, said means for preventing rotation including:

a plurality of ramps formed on the bottom surface of said torque ring, said ramps having an inclined surface and a surface perpendicular to said bottom surface of said torque ring;

a downwardly slanting surface formed on of said jaws adjacent to said torque ring;

whereby said inclined surfaces of said torque ring slide across said downwardly slanting surfaces of said jaws as said torque ring is turned and;

whereby said perpendicular surfaces of said ramps on said torque ring contact trailing edge of said jaws as said torque ring is turned in an opposite direction thereby preventing the rotation of said torque ring.

53. The machine defined in 52, further including:

means for increasing torque required to remove said hollow cover from said hollow body after said flexible compression bushing has been compressed and sealed around the electrical cord, said means for increasing torque include:

a plurality of steep and gradual slopes formed on the perimeter of said torque ring;

a plurality of substantially curved slots formed in the bottom of said torque ring adjacent to said jaws, said curved slots constructed and arranged to allow said torque ring to deform inwardly;

a plurality of longitudinal ridges formed on the inside wall of said hollow cover, said longitudinal ridges including a steep side and a shallow side;

whereby said gradual slopes of said torque ring slide across said shallow side of said ridges as said torque ring is turned in one direction allowing said hollow cover to be threadably attached onto said hollow body and said flexible compression bushing to be compressed; and whereby said steep slopes of said torque ring contact said steep side of said ridges as said torque ring is moved in the opposite direction causing said torque ring to deform inwardly as said hollow cover is removed from said hollow body thereby increasing the torque required to remove said hollow cover from said hollow body and allowing said flexible compression bushing to return to its pre-compressed state.

54. A torque ring to be used in an electrical plug, said torque ring comprising:

a top surface, said top surface having a raised surface extending around the perimeter thereof, the inside of said raised surface forming a perpendicular angle with said top surface the outside of said raised surface forming a downwardly sloping shoulder terminating at the outside diameter of said ring;

a plurality of curved, through slots extending around the outer perimeter of said ring, said through slots constructed and arranged to allow said ring to deform inwardly when radially compressed and return to the original shape when said radially compressive forces are removed;

a bottom surface, said bottom surface including a plurality of ramps, said ramps having an inclined surface and a surface perpendicular to said bottom surface of said torque ring; and a plurality of steep and gradual slopes formed at the outside perimeter of said torque ring.

55. A method of connecting an electrical cord to a plug assembly, said method comprising the steps of:

preparing said cord by partially exposing a plurality of conductors within said cord;

removing a locking screw from a side of a plug body;

un-threaded a sleeve from said plug body;

un-threaded a cover from said plug body;

inserting said cord through said cover and a sealing assembly at a second end of said body;

connecting said conductors to terminations in said sleeve; threading said body onto said sleeve;

threading said locking screw into said body, thereby retaining said sleeve in said body;

adjusting a gripping assembly and tightening said gripping assembly around said cord; and threading said cover onto said body.

* * * * *